US009723894B2

(12) United States Patent
Wright

(10) Patent No.: US 9,723,894 B2
(45) Date of Patent: Aug. 8, 2017

(54) ARTICLE OF FOOTWEAR HAVING AN AUXETIC STRUCTURE

(71) Applicant: NIKE, Inc., Beaverton, OR (US)

(72) Inventor: Zachary C. Wright, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 28 days.

(21) Appl. No.: 14/991,219

(22) Filed: Jan. 8, 2016

(65) Prior Publication Data

US 2016/0219979 A1 Aug. 4, 2016

Related U.S. Application Data

(60) Provisional application No. 62/109,247, filed on Jan. 29, 2015.

(51) Int. Cl.

| | |
|---|---|
| ***A43B 13/02*** | (2006.01) |
| ***A43C 13/04*** | (2006.01) |
| ***A43B 13/22*** | (2006.01) |
| ***A43B 13/12*** | (2006.01) |
| ***A43B 13/14*** | (2006.01) |
| ***A43C 15/16*** | (2006.01) |
| ***A43B 13/04*** | (2006.01) |

(52) U.S. Cl.

CPC ..... *A43B 13/223* (2013.01); *A43B 13/02* (2013.01); *A43B 13/04* (2013.01); *A43B 13/122* (2013.01); *A43B 13/14* (2013.01); *A43B 13/141* (2013.01); *A43C 13/04* (2013.01); *A43C 15/16* (2013.01); *A43C 15/161* (2013.01)

(58) Field of Classification Search

CPC ..... A43B 1/00; A43B 3/0073; A43B 5/00; A43B 13/02; A43B 13/12; A43B 13/122; A43B 13/187; A43C 13/04; A43C 15/16

USPC ..... 36/25 R, 59 R, 59 C, 67 R, 67 D, 134

See application file for complete search history.

(56) References Cited

U.S. PATENT DOCUMENTS

| | | | | |
|---|---|---|---|---|
| 4,439,936 A * | 4/1984 | Clarke | ..... | A43B 5/06 36/102 |
| 4,445,286 A | 5/1984 | Norton | | |
| 4,446,635 A | 5/1984 | Hayden, Jr. | | |

(Continued)

FOREIGN PATENT DOCUMENTS

| | | |
|---|---|---|
| DE | 3521141 A1 | 8/1986 |
| EP | 2353425 A1 | 8/2011 |

(Continued)

OTHER PUBLICATIONS

International Search Report and Written Opinion for PCT Application No. PCT/US2015/067859, mailed Apr. 12, 2016.

(Continued)

*Primary Examiner* — Marie Bays

(74) *Attorney, Agent, or Firm* — Quinn IP Law

(57) ABSTRACT

A sole structure that includes at least one auxetic structure and methods of making are disclosed. A sole structure includes a plate, a first cleat, and an auxetic structure. The plate has an upper surface and a lower surface. The first cleat extends from the lower surface, the first cleat having a first height and having a first tip surface. The auxetic structure has an inner surface affixed to the lower surface and having an outer surface. The inner surface is constrained by the lower surface. The outer surface is spaced closer to the lower surface than to the first tip surface.

32 Claims, 10 Drawing Sheets

(56) References Cited

U.S. PATENT DOCUMENTS 4,454,662 A * 6/1984 Stubblefield ..... A43B 5/00 36/102
4,668,557 A 5/1987 Lakes
5,293,701 A * 3/1994 Sullivan ..... A43C 15/164 36/114
5,832,636 A 11/1998 Lyden et al.
6,161,315 A * 12/2000 Dalton ..... A43B 13/141 36/134
6,255,235 B1 * 7/2001 Hiraoka ..... A41D 19/01547 2/161.3
6,948,264 B1 9/2005 Lyden
7,174,659 B2 * 2/2007 Delgorgue ..... A43B 13/223 36/31
7,952,239 B2 * 5/2011 Clark ..... H01L 41/12 310/26
8,277,719 B2 * 10/2012 Alderson ..... B29C 44/357 264/321
8,375,604 B2 * 2/2013 Eder ..... A43B 13/26 36/114
8,652,602 B1 2/2014 Dolla
8,776,403 B2 * 7/2014 Eder ..... A43B 13/26 36/114
9,402,439 B2 * 8/2016 Cross ..... A43B 13/22
9,456,656 B2 * 10/2016 Cross ..... A43B 13/181
9,474,326 B2 * 10/2016 Langvin ..... A43B 5/00
9,538,811 B2 * 1/2017 Cross ..... A43B 13/02
9,549,590 B2 * 1/2017 Cross ..... A43B 13/187
9,554,620 B2 * 1/2017 Cross ..... B32B 27/065
9,554,622 B2 * 1/2017 Cross ..... A43B 13/14
9,554,624 B2 * 1/2017 Cross ..... A43B 13/22
2003/0093922 A1 * 5/2003 Delgorgue ..... A43B 13/223 36/59 R
2005/0034798 A1 2/2005 Bright
2005/0257405 A1 11/2005 Kilgore
2006/0180505 A1 8/2006 Alderson et al.
2009/0307932 A1 * 12/2009 Kirby ..... A43B 13/223 36/134
2010/0299965 A1 12/2010 Avar et al.
2011/0247237 A1 10/2011 Jara et al.
2011/0247243 A1 10/2011 Eder et al.
2012/0227289 A1 * 9/2012 Beers ..... A43B 3/128 36/25 R
2014/0059897 A1 * 3/2014 Sayed ..... A43B 13/223 36/59 R
2014/0101816 A1 4/2014 Toronjo
2014/0109286 A1 4/2014 Blakely et al.
2014/0202042 A1 7/2014 Berend et al.
2015/0075033 A1 * 3/2015 Cross ..... A43B 13/22 36/103
2015/0075034 A1 * 3/2015 Cross ..... A43B 13/22 36/103
2015/0230548 A1 * 8/2015 Cross ..... A43B 13/187 36/104
2015/0237957 A1 * 8/2015 Cross ..... A43B 13/14 36/30 R
2015/0237958 A1 * 8/2015 Cross ..... A43B 13/181 36/103
2015/0245683 A1 * 9/2015 Cross ..... B32B 27/065 36/103
2015/0245685 A1 * 9/2015 Cross ..... A43B 13/187 36/104
2015/0245686 A1 * 9/2015 Cross ..... A43B 13/02 36/29
2016/0007681 A1 * 1/2016 Langvin ..... A43B 5/00 36/103
2016/0058121 A1 * 3/2016 Langvin ..... A43B 5/06 36/103
2016/0095385 A1 * 4/2016 Nordstrom ..... A43B 13/181 36/29
2016/0157553 A1 * 6/2016 Cross ..... A43B 13/023 36/30 R
2016/0157557 A1 * 6/2016 Cross ..... A43B 13/223 36/25 R
2016/0157558 A1 * 6/2016 Cross ..... A43B 13/14 36/25 R
2016/0219975 A1 * 8/2016 Wright ..... A43B 13/14
2016/0219979 A1 * 8/2016 Wright ..... A43B 13/14
2016/0262491 A1 * 9/2016 Cross ..... A43B 13/14
2016/0374429 A1 * 12/2016 Langvin ..... A43B 5/00 36/25 R
2017/0042284 A1 * 2/2017 Lawless ..... A43B 3/0073
2017/0042285 A1 * 2/2017 Lawless ..... A43B 13/181
2017/0042288 A1 * 2/2017 Lawless ..... A43B 13/223

FOREIGN PATENT DOCUMENTS

JP 2002325601 A 12/2002
WO 2007052054 A1 5/2007
WO 2007090245 A1 8/2007
WO 2008115743 A1 9/2008
WO 2015041796 A1 3/2015
WO 2016122816 A1 8/2016
WO 2016122817 A1 8/2016

OTHER PUBLICATIONS

International Search Report and Written Opinion for PCT Application No. PCT/US2015/067877, mailed Apr. 6, 2016.

* cited by examiner

ARTICLE OF FOOTWEAR HAVING AN AUXETIC STRUCTURE

CROSS-REFERENCE TO RELATED APPLICATION

This application claims priority under 35 U.S.C. §119(e) to U.S. Provisional Patent Application No. 62/109,247, entitled "Article of Footwear Having an Auxetic Structure", and filed on Jan. 29, 2015, which application is hereby incorporated by reference.

FIELD

The present disclosure relates generally to an article of footwear including a cleated shoe, and methods of making an article of footwear.

BACKGROUND

Articles of footwear typically have at least two major components, an upper that provides the enclosure for receiving the wearer's foot, and a sole secured to the upper that is the primary contact to the ground or playing surface. The footwear may also use some type of fastening system, for example, laces or straps or a combination of both, to secure the footwear around the wearer's foot. The sole may comprise three layers an inner sole, a midsole and an outer sole. The outer sole is the primary contact to the ground or the playing surface. It generally carries a tread pattern and/or cleats or spikes or other protuberances that provide the wearer of the footwear with improved traction suitable to the particular athletic, work or recreational activity, or to a particular ground surface.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DESCRIPTION

Figure 1:
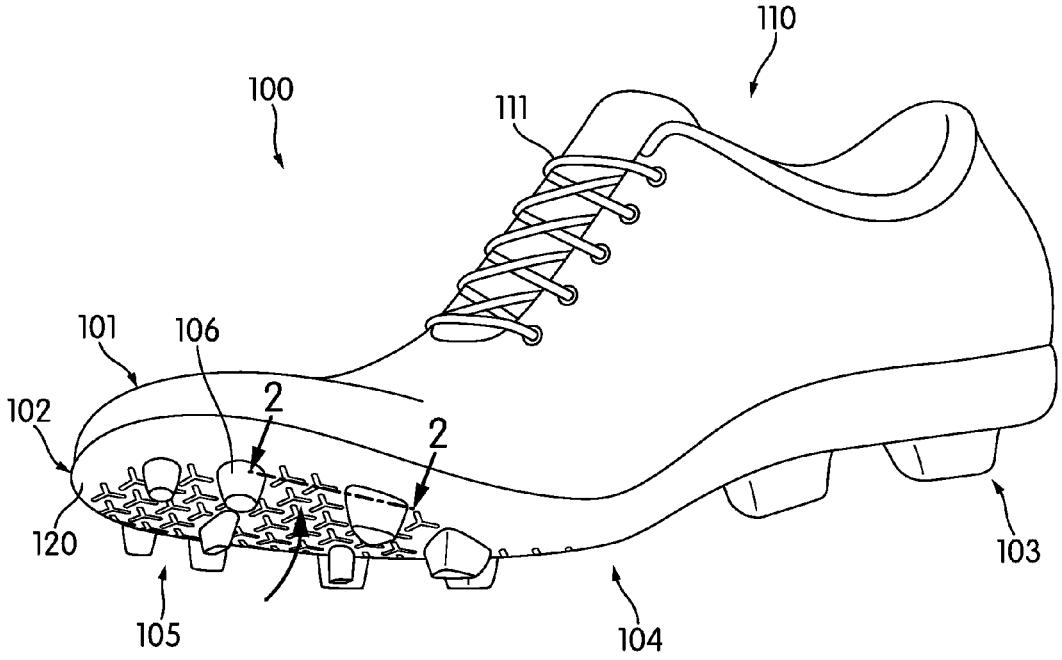
FIG. 1 is an isometric view of an embodiment of an article of footwear with an example of a sole structure with an auxetic structure.

As used herein, the term "auxetic structure" generally refers to a structure that, when it is placed under tension in a first direction, increases its dimensions in a direction that is orthogonal to the first direction. For example, if the structure can be described as having a length, a width and a thickness, then when the structure is under tension longitudinally, it increases in width. In certain of the embodiments, the auxetic structures are bi-directional such that they increase in length and width when stretched longitudinally and in width and length when stretched laterally, but do not increase in thickness. Such auxetic structures are characterized by having a negative Poisson's ratio. Also, although such structures will generally have at least a monotonic relationship between the applied tension and the increase in the dimension orthogonal to the direction of the tension, that relationship need not be proportional or linear, and in general need only increase in response to increased tension.

The article of footwear includes an upper and a sole. The sole may include an inner sole, a midsole and an outer sole. The sole includes at least one layer made of an auxetic structure. This layer can be referred to as an "auxetic layer." When the person wearing the footwear engages in an activity, such as running, turning, leaping or accelerating, that puts the auxetic layer under increased longitudinal or lateral tension, the auxetic layer increases its length and width and thus provides improved traction, as well as absorbing some of the impact with the playing surface. Moreover, as discussed further, the auxetic structure may reduce an adherence of debris and reduce a weight of debris absorbed by the outer sole. Although the descriptions below only discuss a limited number of types of footwear, embodiments can be adapted for many sport and recreational activities, including tennis and other racquet sports, walking, jogging, running, hiking, handball, training, running or walking on a treadmill, as well as team sports such as basketball, volleyball, lacrosse, field hockey and soccer.

An article of footwear is disclosed. The article of footwear may generally have a sole structure that includes a plate, a first cleat, and an auxetic structure. The plate has an upper surface and a lower surface. The first cleat extends from the lower surface, the first cleat having a first height and having a first tip surface. The auxetic structure has an inner surface affixed to the lower surface and having an outer surface. The inner surface is constrained by the lower surface. The outer surface is spaced closer to the lower surface than to the first tip surface.

The article of footwear including an auxetic structure may be configured such that the auxetic structure includes a tristar-shaped pattern.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first central angle with the second radial segment. The first radial segment may have a second central angle with the third radial segment. The first central angle and the second central angle may be equal.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height. The first radial segment may have a first central angle with the second radial segment. The first radial segment may have a second central angle with the third radial segment. The first central angle and the second central angle may be equal.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may be aligned with a radial segment of another one of the plurality of tristar-shaped voids.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height. The first radial segment may be aligned with a radial segment of another one of the plurality of tristar-shaped voids.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height. The first radial segment may have a first central angle with the second radial segment. The first radial segment may have a second central angle with the third radial segment. The first central angle and the second central angle may be equal. The first radial segment may be aligned with a radial segment of another one of the plurality of tristar-shaped voids.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height. The first radial segment may have a first central angle with the second radial segment. The first radial segment may have a second central angle with the third radial segment. The first central angle and the second central angle may be equal. The first radial segment may be aligned with a radial segment of another one of the plurality of tristar-shaped voids. The inner surface and the outer surface are spaced by a first separation distance of less than half of the first height.

The article of footwear including an auxetic structure may be configured such that the first cleat is attached to the lower surface. The outer surface may include a plurality of voids. The outer surface may have a first surface area when not exposed to a compressive force and wherein the outer surface has a second surface area when exposed to the compressive force. The second surface area may be at least five percent more than the first surface area. The outer surface may be spaced closer to the lower surface than to the first tip surface.

The article of footwear including an auxetic structure may be configured such that the first cleat is attached to the lower surface. The outer surface may include a plurality of voids. The outer surface may have a first surface area when not exposed to a compressive force and wherein the outer surface has a second surface area when exposed to the compressive force. The second surface area may be at least five percent more than the first surface area. The outer surface may be spaced closer to the lower surface than to the first tip surface. The compressive force may modify a separation distance between the inner surface and the outer surface.

The article of footwear including an auxetic structure may be configured such that the first cleat is attached to the lower surface. The outer surface may include a plurality of voids. The outer surface may have a first surface area when not exposed to a compressive force and wherein the outer surface has a second surface area when exposed to the compressive force. The second surface area may be at least five percent more than the first surface area. The outer surface may be spaced closer to the lower surface than to the first tip surface. A first void of the plurality of voids may include a first portion and a second portion. The compressive force may result in a first decrease in a surface area of the first portion. The compressive force may result in a second decrease of a surface area of the second portion. The first decrease may be at least five percent greater than the second decrease.

The article of footwear including an auxetic structure may be configured such that the first cleat is attached to the lower surface. The outer surface may include a plurality of voids. The outer surface may have a first surface area when not exposed to a compressive force and wherein the outer surface has a second surface area when exposed to the compressive force. The second surface area may be at least five percent more than the first surface area. The outer surface may be spaced closer to the lower surface than to the first tip surface. The compressive force may modify a separation distance between the inner surface and the outer surface. A first void of the plurality of voids may include a first portion and a second portion. The compressive force may result in a first decrease in a surface area of the first portion. The compressive force may result in a second decrease of a surface area of the second portion. The first decrease may be at least five percent greater than the second decrease.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height. The first radial segment may have a first central angle with the second radial segment. The first radial segment may have a second central angle with the third radial segment. The first central angle and the second central angle may be equal. The first radial segment may be aligned with a radial segment of another one of the plurality of tristar-shaped voids. The inner surface and the outer surface are spaced by a first separation distance of less than half of the first height. The upper surface is attached to an upper of an article of footwear.

The article of footwear including an auxetic structure may be configured such that the first cleat is attached to the lower surface. The outer surface may include a plurality of voids. The outer surface may have a first surface area when not exposed to a compressive force and wherein the outer surface has a second surface area when exposed to the compressive force. The second surface area may be at least five percent more than the first surface area. The outer surface may be spaced closer to the lower surface than to the first tip surface. The compressive force may modify a separation distance between the inner surface and the outer surface. A first void of the plurality of voids may include a first portion and a second portion. The compressive force may result in a first decrease in a surface area of the first portion. The compressive force may result in a second decrease of a surface area of the second portion. The first decrease may be at least five percent greater than the second decrease. The upper surface is attached to an upper of an article of footwear.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height. The first radial segment may have a first central angle with the second radial segment. The first radial segment may have a second central angle with the third radial segment. The first central angle and the second central angle may be equal. The first radial segment may be aligned with a radial segment of another one of the plurality of tristar-shaped voids. The inner surface and the outer surface are spaced by a first separation distance of less than half of the first height. The upper surface is attached to an upper of an article of footwear. An adherence of debris onto the outer surface may be at least fifteen percent less than an adherence of debris onto a control outsole. The control outsole may be identical to the sole structure except that the control outsole does not include the auxetic structure. The control outsole may include a control plate having an exposed control surface.

The article of footwear including an auxetic structure may be configured such that the first cleat is attached to the lower surface. The outer surface may include a plurality of voids. The outer surface may have a first surface area when not exposed to a compressive force and wherein the outer surface has a second surface area when exposed to the compressive force. The second surface area may be at least five percent more than the first surface area. The outer surface may be spaced closer to the lower surface than to the first tip surface. The compressive force may modify a separation distance between the inner surface and the outer surface. A first void of the plurality of voids may include a first portion and a second portion. The compressive force may result in a first decrease in a surface area of the first portion. The compressive force may result in a second decrease of a surface area of the second portion. The first decrease may be at least five percent greater than the second decrease. The upper surface is attached to an upper of an article of footwear. An adherence of debris onto the outer surface may be at least fifteen percent less than an adherence of debris onto a control outsole. The control outsole may be identical to the sole structure except that the control outsole does not include the auxetic structure. The control outsole may include a control plate having an exposed control surface.

The article of footwear including an auxetic structure may be also configured such that the auxetic structure includes a tristar-shaped pattern. Moreover, the tristar-shaped pattern may include a plurality of tristar-shaped voids, each tristar-shaped void comprising a center and three radial segments extending from the center. Further, a first tristar-shaped void of the plurality of tristar-shaped voids may include a first radial segment, a second radial segment, and a third radial segment. Additionally, the first radial segment, the second radial segment, and the third radial segment may be equal in length. The first radial segment may have a first length of between 1/50 and 1/2 of the first height. The first radial segment may have a first central angle with the second radial segment. The first radial segment may have a second central angle with the third radial segment. The first central angle and the second central angle may be equal. The first radial segment may be aligned with a radial segment of another one of the plurality of tristar-shaped voids. The inner surface and the outer surface are spaced by a first separation distance of less than half of the first height. The upper surface is attached to an upper of an article of footwear. An adherence of debris onto the outer surface may be at least fifteen percent less than an adherence of debris onto a control outsole. The control outsole may be identical to the sole structure except that the control outsole does not include the auxetic structure. The control outsole may include a control plate having an exposed control surface. Following a 30 minute wear test on a wet grass field, a weight of debris adsorbed to the outer surface may be at least fifteen percent less than a weight of debris adsorbed to a control outsole. The control outsole may be identical to the sole structure except that the control outsole does not include the auxetic structure. The control outsole may include a control plate having an exposed control surface.

The article of footwear including an auxetic structure may be configured such that the first cleat is attached to the lower surface. The outer surface may include a plurality of voids. The outer surface may have a first surface area when not exposed to a compressive force and wherein the outer surface has a second surface area when exposed to the compressive force. The second surface area may be at least five percent more than the first surface area. The outer surface may be spaced closer to the lower surface than to the first tip surface. The compressive force may modify a separation distance between the inner surface and the outer surface. A first void of the plurality of voids may include a first portion and a second portion. The compressive force may result in a first decrease in a surface area of the first portion. The compressive force may result in a second decrease of a surface area of the second portion. The first decrease may be at least five percent greater than the second decrease. The upper surface is attached to an upper of an article of footwear. An adherence of debris onto the outer surface may be at least fifteen percent less than an adherence of debris onto a control outsole. The control outsole may be identical to the sole structure except that the control outsole does not include the auxetic structure. The control outsole may include a control plate having an exposed control surface. Following a 30 minute wear test on a wet grass field, a weight of debris adsorbed to the outer surface may be at least fifteen percent less than a weight of debris adsorbed to a control outsole. The control outsole may be identical to the sole structure except that the control outsole does not include the auxetic structure. The control outsole may include a control plate having an exposed control surface.

A method of manufacturing a sole structure is disclosed. The method of manufacturing a sole structure may generally include providing a plate having an upper surface and a lower surface, providing an auxetic structure having an inner surface and an outer surface, and bonding the inner surface to the lower surface. The plate is configured to receive a first cleat having a first height. A separation distance between the inner surface and the outer surface is less than half of the first height. The inner surface is constrained by the lower surface following the bonding.

The method including providing an auxetic structure may be configured such that the auxetic structure includes a tristar-shaped pattern.

The method including providing an auxetic structure may be configured such that the bonding bonds a substantial portion of the inner surface to the lower surface.

The method including providing an auxetic structure may be configured such that the auxetic structure includes a tristar-shaped pattern. The method including providing an auxetic structure may be configured such that the bonding bonds a substantial portion of the inner surface to the lower surface.

The method including providing an auxetic structure may be configured to include forming the auxetic structure of one or more of ethylene vinyl acetate (EVA), polyisoprene, polybutadiene, polyisobutylene, and polyurethanes.

The method including providing an auxetic structure may be configured such that the auxetic structure includes a tristar-shaped pattern. The method including providing an auxetic structure may be configured to include forming the auxetic structure of one or more of ethylene vinyl acetate (EVA), polyisoprene, polybutadiene, polyisobutylene, and polyurethanes.

The method including providing an auxetic structure may be configured such that the bonding bonds a substantial portion of the inner surface to the lower surface. The method including providing an auxetic structure may be configured to include forming the auxetic structure of one or more of ethylene vinyl acetate (EVA), polyisoprene, polybutadiene, polyisobutylene, and polyurethanes.

The method including providing an auxetic structure may be configured such that the auxetic structure includes a tristar-shaped pattern. The method including providing an auxetic structure may be configured such that the bonding bonds a substantial portion of the inner surface to the lower surface. The method including providing an auxetic structure may be configured to include forming the auxetic structure of one or more of ethylene vinyl acetate (EVA), polyisoprene, polybutadiene, polyisobutylene, and polyurethanes.

The method including providing an auxetic structure may be configured to include forming the auxetic structure of one or more of acrylic, nylon, polybenzimidazole, polyethylene, polypropylene, polystyrene, polyvinyl chloride (PVC), and polytetrafluoroethylene (PTFE).

The method including providing an auxetic structure may be configured such that the auxetic structure includes a tristar-shaped pattern. The method including providing an auxetic structure may be configured to include forming the auxetic structure of one or more of acrylic, nylon, polybenzimidazole, polyethylene, polypropylene, polystyrene, polyvinyl chloride (PVC), and polytetrafluoroethylene (PTFE).

The method including providing an auxetic structure may be configured such that the bonding bonds a substantial portion of the inner surface to the lower surface. The method including providing an auxetic structure may be configured to include forming the auxetic structure of one or more of acrylic, nylon, polybenzimidazole, polyethylene, polypropylene, polystyrene, polyvinyl chloride (PVC), and polytetrafluoroethylene (PTFE).

The method including providing an auxetic structure may be configured such that the auxetic structure includes a tristar-shaped pattern. The method including providing an auxetic structure may be configured such that the bonding bonds a substantial portion of the inner surface to the lower surface. The method including providing an auxetic structure may be configured to include forming the auxetic structure of one or more of acrylic, nylon, polybenzimidazole, polyethylene, polypropylene, polystyrene, polyvinyl chloride (PVC), and polytetrafluoroethylene (PTFE).

The method including providing an auxetic structure may be configured such that the auxetic structure includes a tristar-shaped pattern. The method including providing an auxetic structure may be configured such that the bonding bonds a substantial portion of the inner surface to the lower surface. The method including providing an auxetic structure may be configured to include forming the auxetic structure of one or more of ethylene vinyl acetate (EVA), polyisoprene, polybutadiene, polyisobutylene, and polyurethanes. The method including providing an auxetic structure may be configured to include providing an upper of an article of footwear. The method including providing an auxetic structure may be configured to include attaching the upper to the upper surface.

The method including providing an auxetic structure may be configured such that the auxetic structure includes a tristar-shaped pattern. The method including providing an auxetic structure may be configured such that the bonding bonds a substantial portion of the inner surface to the lower surface. The method including providing an auxetic structure may be configured to include forming the auxetic structure of one or more of acrylic, nylon, polybenzimidazole, polyethylene, polypropylene, polystyrene, polyvinyl chloride (PVC), and polytetrafluoroethylene (PTFE). The method including providing an auxetic structure may be configured to include providing an upper of an article of footwear. The method including providing an auxetic structure may be configured to include attaching the upper to the upper surface.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

For clarity, the detailed descriptions herein describe certain exemplary embodiments, but the disclosure herein may be applied to any article of footwear comprising certain of the features described herein and recited in the claims. In particular, although the following detailed description discusses exemplary embodiments, in the form of footwear such as running shoes, jogging shoes, tennis, squash or racquetball shoes, basketball shoes, sandals and flippers, the disclosures herein may be applied to a wide range of footwear.

The term "sole structure", also referred to simply as "sole", herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer covering, an outsole, a midsole and an inner sole.

FIG. 1 is an isometric view of an embodiment of an article of footwear 100. Article of footwear 100 may include upper 101 and sole structure 102, also referred to hereafter simply as sole 102. Upper 101 has a heel region 103, an instep or midfoot region 104 and a forefoot region 105. Upper 101 may include an opening or throat 110 that allows the wearer to insert his or her foot into the footwear. In some embodiments, upper 101 may also include laces 111, which can be used to tighten or otherwise adjust upper 101 around a foot. The upper 101 may be attached to the sole 102 by any known mechanism or method. For example, upper 101 may be stitched to sole 102 or upper 101 may be glued to sole 102.

The exemplary embodiment shows a generic design for the upper. In some embodiments, the upper may include another type of design. For instance, the upper 101 may be a seamless warp knit tube of mesh. The upper 101 may be made from materials known in the art for making articles of footwear. For example, the upper 101 may be made from nylon, natural leather, synthetic leather, natural rubber, or synthetic rubber.

Figure 2:
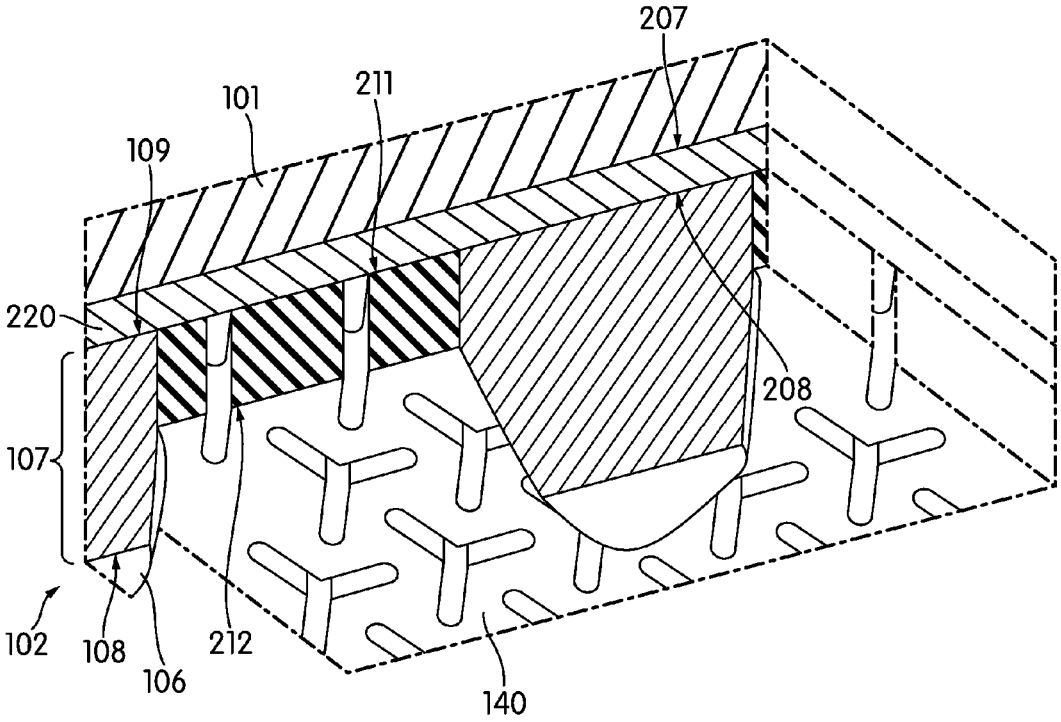
FIG. 2 is a cut away view of an embodiment of the article of footwear shown in FIG. 1.

As shown in FIG. 2, the sole 102 may include a plate 220. The plate 220 may be made from materials known in the art for making articles of footwear. For example, the plate 220 may be made from elastomers, siloxanes, natural rubber, synthetic rubbers, aluminum, steel, natural leather, synthetic leather, plastics, or thermoplastics. The plate may be provided by various techniques know in the art. In some embodiments, the plate 220 may be provided as prefabricated. In other embodiments, the plate 220 may be provided by, for example, molding the plate 220 in a molding cavity (not shown).

The plate may be various shapes and sizes. For example, as shown in FIG. 2, the plate 220 includes an upper surface 207 and a lower surface 208. In some embodiments, the upper surface may be attached to the upper. For example, as shown in FIG. 2, the upper surface 207 is attached to the upper 101.

The plate may include components other than cleats that contact a playing surface and increase traction. In some embodiments, the plate may include traction elements that are smaller than cleats or studs. The traction elements on the plate may increase control for a wearer when maneuvering forward on a surface by engaging surface. Additionally, traction elements may also increase the wearer's stability when making lateral movements by digging into playing surface. In some embodiments, the traction elements may be molded into the plate. In some embodiments, the plate may be configured to receive removable traction elements.

In some instances it is desirable to include non-clogging provisions for surfaces spaced from the ground-contacting surface in order to prevent debris from interfering with the ground-contacting surface. Accordingly, in certain embodiments, the sole includes an auxetic structure. For example, as shown in FIG. 2, the sole 102 includes an auxetic structure 140. As discussed further below, the auxetic structure may have various characteristics to expel debris adhered on the sole.

The auxetic structure may be made from materials known in the art for making articles of footwear. For example, the auxetic structure 140 may be formed of one or more of ethylene vinyl acetate (EVA), polyisoprene, polybutadiene, polyisobutylene, and polyurethanes. In another example, the auxetic structure 140 may be formed of one or more of acrylic, nylon, polybenzimidazole, polyethylene, polypropylene, polystyrene, polyvinyl chloride (PVC), and polytetrafluoroethylene (PTFE).

The auxetic structure may be provided by various techniques know in the art. In some embodiments, the auxetic structure 140 may be provided as prefabricated. In other embodiments, the auxetic structure 140 may be provided by, for example, molding the auxetic structure 140 in a molding cavity.

The auxetic structure 140 may include an inner surface. For example, as shown in FIG. 2, the auxetic structure 140 includes an inner surface 211. Similarly, the auxetic structure may include an outer surface. For example, as shown in FIG. 2, the auxetic structure 140 includes an outer surface 212.

In certain embodiments, the auxetic structure is attached to the plate. For example, the auxetic structure 140 is attached to the plate 220. Specifically, the inner surface 211 of the auxetic structure 140 may be affixed to the lower surface 208 of plate 220. The auxetic structure 140 may be attached or affixed to the plate 220 by any known mechanism or method. For example, auxetic structure 140 may be stitched to plate 220 or auxetic structure 140 may be bonded and/or glued to plate 220. In another example, inner surface 211 may be stitched to lower surface 208 or inner surface 211 may be bonded and/or glued to lower surface 208. In certain embodiments, more than eighty percent of a surface area of the surface is bonded. For example, as shown in FIG. 2, an adhesive bonds a more than eighty percent of the inner surface 211 to the lower surface 208.

The auxetic structure may be constrained by the plate. As used herein, a surface is constrained when a shape of the surface conforms to a shape of another surface. For example, the auxetic structure 140 is constrained to conform to a shape of the plate 220. Similarly, the inner surface may be constrained by the lower surface. For example, the inner surface 211 is constrained to have a shape of the lower surface 208.

In some embodiments, sole 102 may include at least one cleat that may be the primary ground-contacting surface (e.g., ground-engaging surface). For example, the cleats may be configured to contact grass, synthetic turf, dirt, or sand. As shown, for example, in FIGS. 1 and 2, the sole 102 may include cleat 106. The cleats may include provisions for increasing traction with a playing surface. Similarly, in various embodiments, the auxetic structure may be spaced from the ground-contacting surface (e.g., ground-engaging surface). For example, as shown in FIGS. 1 and 2, the auxetic structure 140 may be spaced from the tip of cleat 106 in the vertical direction.

The cleat may have a tip surface of various shapes and/or sizes. In some embodiments, the tip surface forms the ground-engaging surface of the cleat. For example, as shown in FIG. 2, the cleat 106 has tip surface 108 that forms the ground-engaging surface. Similarly, the cleat may have various heights in different embodiments. For example, as shown in FIG. 2, the cleat 106 has a height 107 that spaces the ground-engaging surface from the outer surface 212. The height may extend between a base surface of the cleat and the tip surface. For example, height 107 extends between a base surface 109 of the cleat 106 and the tip surface 108. In some embodiments, the outer surface is spaced closer to the lower surface than to the tip surface. For example, as shown in FIG. 2, the outer surface 212 is spaced closer to the lower surface 208 than to the tip surface 108. In other embodiments, the outer surface is spaced equidistant to the lower surface and to the tip surface (not shown).

In some embodiments, cleats may include one or more of a circular cleat, a wide cleat, and a triangular cleat. For example, as shown, for example in FIG. 3, circular cleat 170, wide cleat 172, and triangular cleat 174 may be disposed on forefoot region 125 of sole 102. Moreover, additional cleats may be disposed on heel portion of sole and/or on midfoot portion of sole. For example, in FIG. 3, heel cleat 176 may be disposed on the heel region 123.

Figure 3:
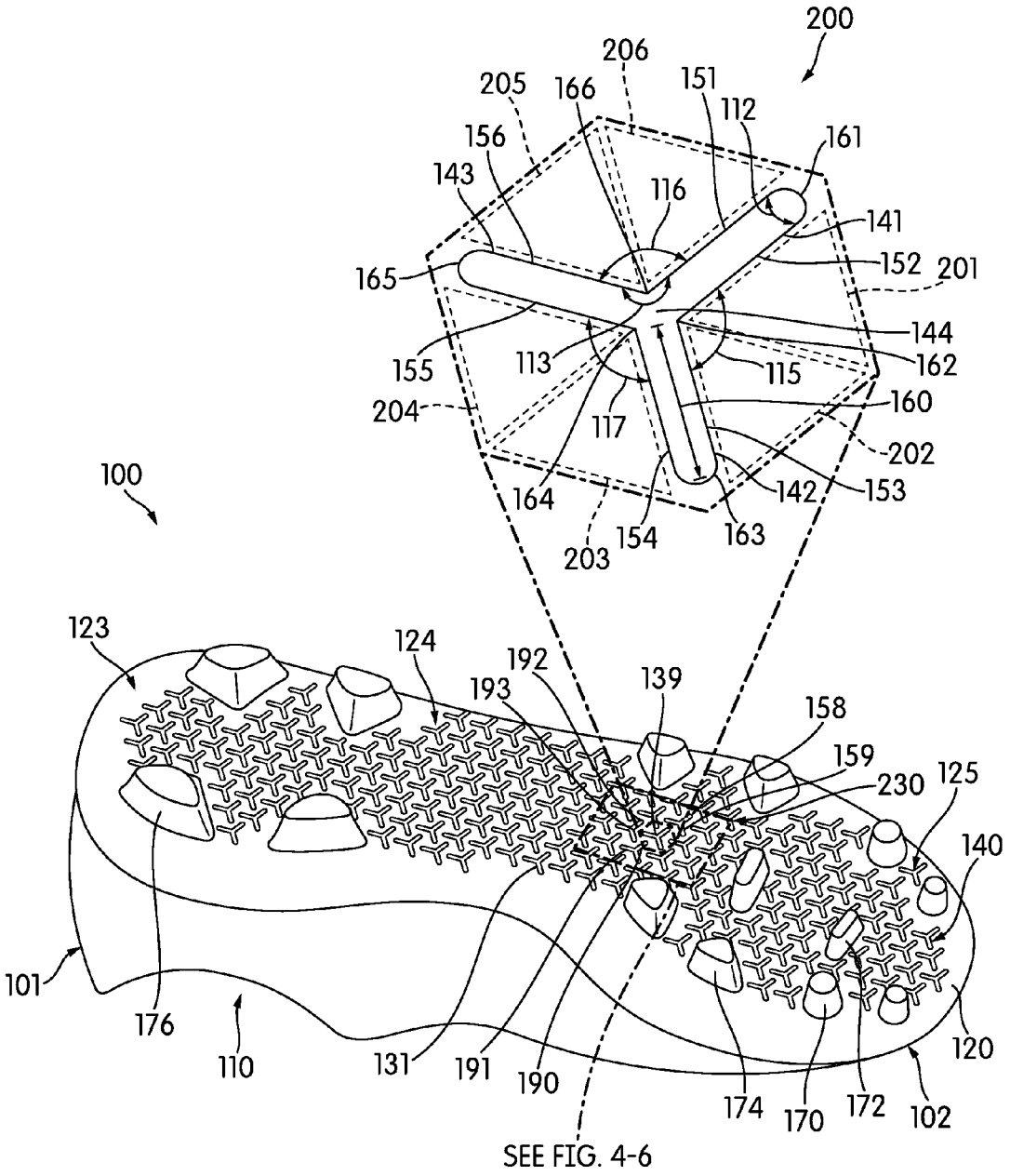
FIG. 3 is a schematic diagram of a bottom perspective view of an embodiment of the article of footwear shown in FIG. 1.

The cleats may be attached to the article 100 using various techniques and methods. For example, as shown in FIG. 2, the plate may be configured to receive cleats. In another example, sole 102 may include cleats integrally formed with plate 220 through molding. In some embodiments, the plate may include cleat receiving members configured to receive removable cleat members. For example, the cleat receiving members may include threaded holes and the cleats may screw into the threaded holes. Cleat 106 may be treated as an exemplary cleat. Accordingly, the various properties and characteristics of cleat 106 may apply to other cleats. For example, as shown in FIG. 3, one or more of a circular cleat 170, a wide cleat 172, and a triangular cleat 174 may have a tip surface and/or height similar to the cleat 106. Furthermore, additional cleats having similar geometries to circular cleat 170, wide cleat 172, and triangular cleat 174 may also have at least some similar properties and characteristics to cleat 106.

The cleats may be made from materials known in the art for making articles of footwear. For example, the cleats may be made from elastomers, siloxanes, natural rubber, synthetic rubbers, aluminum, steel, natural leather, synthetic leather, plastics, or thermoplastics. In some embodiments, the cleats may be made of the same materials. In other embodiments, the cleats may be made of different materials. For example, circular cleat 170 may be made of aluminum while wide cleat 172 may be made of a thermoplastic material.

The cleats may have any type of shape. For example, in the exemplary embodiment shown in FIG. 3, circular cleat 170 has a circular shape, wide cleat 172 has a rectangular shape, and triangular cleat 174 has a triangular shape. In some embodiments, the cleats may have similar or even identical shapes. In other embodiments, at least one of the cleats may have a different shape from another cleat. In some embodiments, the cleats may have a first set of identically shaped cleats and/or a second set of identically shaped cleats.

In some embodiments, the cleats may have the same height, width, and/or thickness as each other. In other embodiments, the cleats may have different heights, different widths, and/or different thicknesses from each other. In some embodiments, a first set of cleats may have the same height, width, and/or thickness as each other, while a second set of cleats may have a different height, width, and/or thickness from the first set of cleats.

The cleats may be arranged in any cleat pattern on the plate. While embodiments of FIGS. 1-15 are illustrated with the same cleat pattern (arrangement), it is understood that other cleat patterns may be used with the plate. The arrangement of the cleats may enhance traction for a wearer during cutting, turning, stopping, accelerating, and backward movement.

FIG. 3 is a bottom perspective view of an embodiment of an article of footwear. This figure shows the auxetic structure 140. Auxetic structure 140 may have a heel region 123, an instep or midfoot region 124, and a forefoot region 125 as shown in FIG. 3.

The auxetic structure may be various shapes and sizes. As used herein, an auxetic structure may have a negative Poisson's ratio. In some embodiments, the auxetic structure may have a particular shape that results in a negative Poisson's ratio. For example, as shown in FIG. 3, the auxetic structure 140 may have a tristar-shaped pattern. In another example, the auxetic structure may have an auxetic hexagon that stretches toward a square-shaped pattern. In other embodiments, the auxetic structure may be formed of a material having an auxetic characteristic. For example, the auxetic structure 140 may be formed using foam structures having a negative Poisson's ratio. In some embodiments, the auxetic structure 140 may form more than seventy percent of the exposed surface of the outsole 120. In other embodiments, the auxetic structure forms less than seventy percent of the outsole 120. For example, the auxetic structure 140 may extend in a midfoot region 104 and the auxetic structure may be omitted from the heel region 103 and forefoot region 105 (not shown).

In the exemplary embodiment, the auxetic structure 140 has a tristar-shaped pattern having radial segments that are joined to each other at their center. The radial segments at the center may function as hinges, allowing the radial segments to rotate as the sole is placed under tension. This action may allow the portion of the sole under tension to expand both in the direction under tension and in the direction in the plane of the sole that is orthogonal to the direction under tension. Thus, the tristar-shaped pattern may form an auxetic structure 140 for outsole 120 to enhance operation of the outsole 120, which is described in further detail below. As previously noted, in other embodiments, other shapes and/or patterns that result in a negative Poisson's ratio may be used. In certain embodiments, the auxetic structure is formed using a material having an auxetic characteristic. For example, the auxetic structure 140 may be formed of a material that is auxetic at a microscopic level.

As shown in FIG. 3, auxetic structure 140 includes a plurality of tristar-shaped voids 131, also referred to simply as voids 131 hereafter. As an example, an enlarged view of void 139 of plurality of voids 131 is shown schematically within FIG. 3. Void 139 is further depicted as having a first radial segment 141, a second radial segment 142, and a third radial segment 143. Each of these portions is joined together at a center 144. Similarly, in some embodiments, each of the remaining voids in voids 131 may include three radial segments that are joined together, and extend outwardly from, a center.

In some embodiments, a difference between lengths of the radial segments is less than ten percent. For example, as shown in FIG. 3, a difference between lengths of the first radial segment 141, a second radial segment 142, and a third radial segment 143 is less than ten percent. Moreover, in various embodiments, the length of a radial segment may be less than a height of a cleat. For example, as shown in FIGS. 2 and 3, the length 160 of the second radial segment 142 is less than ½ of the height 107 of the cleat 106. In other embodiments, the length is between 1/50 and ½ of the height. For example, as shown, the length 160 is between 1/50 and ½ of the height 107.

Generally, each void in plurality of voids 131 may have any kind of geometry. In some embodiments, a void may have a polygonal geometry, including a convex and/or concave polygonal geometry. In such cases, a void may be characterized as comprising a particular number of vertices and edges (or sides). In an exemplary embodiment, voids 131 may be characterized as having six sides and six vertices. For example, void 139 is shown as having first side 151, second side 152, third side 153, fourth side 154, fifth side 155 and sixth side 156. Additionally, void 139 is shown as having a first vertex 161, second vertex 162, third vertex 163, fourth vertex 164, fifth vertex 165 and sixth vertex 166. It may be appreciated that in the exemplary embodiment, some of the vertices (e.g., first vertex 161, third vertex 163 and fifth vertex 165) may not be point-like vertices. Instead, the edges joining at these vertices may be curved at these vertices to provide a more smooth (e.g., less pointed) vertex geometry. In contrast, in the exemplary embodiment, some vertices may have point-like geometries, including second vertex 162, fourth vertex 164 and sixth vertex 166.

In one embodiment, the shape of void 139 (and correspondingly of one or more of voids 131) could be characterized as a regular polygon (not shown), which is both cyclic and equilateral. In some embodiments, the geometry of void 139 can be characterized as triangles with sides that, instead of being straight, have an inwardly-pointing vertex at the midpoint of the side (not shown). The reentrant angle formed at these inwardly-pointing vertices can range from 180° (when the side is perfectly straight) to, for example, 120° or less.

The shape of void 139 may be formed of other geometries, including a variety of polygonal and/or curved geometries. Exemplary polygonal shapes that may be used with one or more of voids 131 include, but are not limited to: regular polygonal shapes (e.g., triangular, rectangular, pentagonal, hexagonal, etc.) as well as irregular polygonal shapes or non-polygonal shapes. Other geometries could be described as being quadrilateral, pentagonal, hexagonal, heptagonal, octagonal or other polygonal shapes with reentrant sides. In still other embodiments, the geometry of one or more voids need not be polygonal, and instead voids could have any curved and/or non-linear geometries, including sides or edges with curved or non-linear shapes.

In the exemplary embodiment, the vertices of a void (e.g., void 139) may correspond to interior angles that are less than 180 degrees or interior angles that are greater than 180 degrees. For example, with respect to void 139, first vertex 161, third vertex 163 and fifth vertex 165 may correspond to interior angles that are less than 180 degrees. In this particular example, each of first vertex 161, third vertex 163 and fifth vertex 165 has an interior angle 112 that is less than 180 degrees. In other words, void 139 may have a locally convex geometry at each of these vertices (relative to the outer side of void 139). In contrast, second vertex 162, fourth vertex 164 and sixth vertex 166 may correspond to interior angle 113 that are greater than 180 degrees. In other words, void 139 may have a locally concave geometry at each of these vertices (relative to the outer side of void 139).

In various embodiments, the depicted voids have central angles that are approximately equal. In some embodiments, the first central angle and the second central angle are approximately equal. For example, as shown in FIG. 3, the first central angle 115 and the second central angle 116 are approximately equal. In some cases, the first central angle 115 and the central angle 116 could differ by an angle approximately in the range between 0.1 degrees and 10 degrees. Similarly, in various embodiments, the first central angle and the third central angle are approximately equal. For example, as shown in FIG. 3, the first central angle 115 and the third central angle 117 are approximately equal.

Although the embodiments depict voids having approximately polygonal geometries, including approximately arc-like vertices at which adjoining sides or edges are connected by an arc, in other embodiments some or all of a void could be non-polygonal. In particular, in some cases, the outer edges or sides of some or all of a void may not be joined at vertices, but may be continuously curved. Moreover, some embodiments can include voids having a geometry that includes both straight edges connected via vertices as well as curved or non-linear edges without any points or vertices.

In some embodiments, voids 131 may be arranged in a regular pattern on auxetic structure 140. In some embodiments, voids 131 may be arranged such that each vertex of a void is disposed near the vertex of another void (e.g., an adjacent or nearby void). More specifically, in some cases, voids 131 may be arranged such that every vertex that has an interior angle less than 180 degrees is disposed near a vertex that has an interior angle greater than 180 degrees. As one example, fourth vertex 164 of void 139 is disposed near, or adjacent to, a vertex 190 of another void 191. Here, vertex 190 is seen to have an interior angle that is less than 180 degrees, while fourth vertex 164 has an interior angle that is greater than 180 degrees. Similarly, fifth vertex 165 of void 139 is disposed near, or adjacent to, a vertex 193 of another void 192. Here, vertex 193 is seen to have an interior angle that is greater than 180 degrees, while fifth vertex 165 has an interior angle that is greater than 180 degrees.

In various embodiments, the radial segments of one void may be aligned with a radial segment of another one of the voids such that a difference in angle between the radial segments is less than 5 degrees. For example, as shown in FIG. 3, the first radial segment 141 of void 139 may be aligned with a radial segment 158 of void 159 of the voids 131 such that a difference in angle between the radial segments is less than 5 degrees.

The configuration resulting from the above arrangement may be seen to divide auxetic structure 140 into smaller geometric portions, whose boundaries are defined by the edges of voids 131. In some embodiments, these geometric portions may be formed of sole portions which are polygonal in shape. For example, in the exemplary embodiment, voids 131 are arranged in a manner that defines a plurality of sole portions 200, also referred to hereafter simply as sole portions 200. In other embodiments, the sole portions have other shapes.

Generally, the geometry of sole portions 200 may be defined by the geometry of voids 131 as well as their arrangement on auxetic structure 140. In the exemplary configuration, voids 131 are shaped and arranged to define a plurality of approximately triangular portions, with boundaries defined by edges of adjacent voids. Of course, in other embodiments polygonal portions could have any other shape, including rectangular, pentagonal, hexagonal, as well as possibly other kinds of regular and irregular polygonal shapes. Furthermore, it will be understood that in other embodiments, voids may be arranged on an outsole to define geometric portions that are not necessarily polygonal (e.g., comprised of approximately straight edges joined at vertices). The shapes of geometric portions in other embodiments could vary and could include various rounded, curved, contoured, wavy, nonlinear as well as any other kinds of shapes or shape characteristics.

As seen in FIG. 3, sole portions 200 may be arranged in regular geometric patterns around each void. For example, void 139 is seen to be associated with first polygonal portion 201, second polygonal portion 202, third polygonal portion 203, fourth polygonal portion 204, fifth polygonal portion 205 and sixth polygonal portion 206. Moreover, the approximately even arrangement of these polygonal portions around void 139 forms an approximately hexagonal shape that surrounds void 139.

In some embodiments, the various vertices of a void may function as a hinge. In particular, in some embodiments, adjacent portions of material, including one or more geometric portions (e.g., polygonal portions), may rotate about a hinge portion associated with a vertex of the void. As one example, each vertex of void 139 is associated with a corresponding hinge portion, which joins adjacent polygonal portions in a rotatable manner.

In the exemplary embodiment, void 139 includes hinge portion 210 (see FIGS. 4-6), which is associated with first vertex 161. Hinge portion 210 is comprised of a relatively small portion of material adjoining first polygonal portion 201 and sixth polygonal portion 206. As discussed in further detail below, first polygonal portion 201 and sixth polygonal portion 206 may rotate (or pivot) with respect to one another at hinge portion 210. In a similar manner, each of the remaining vertices of void 139 is associated with similar hinge portions that join adjacent polygonal portions in a rotatable manner.

Figure 4:
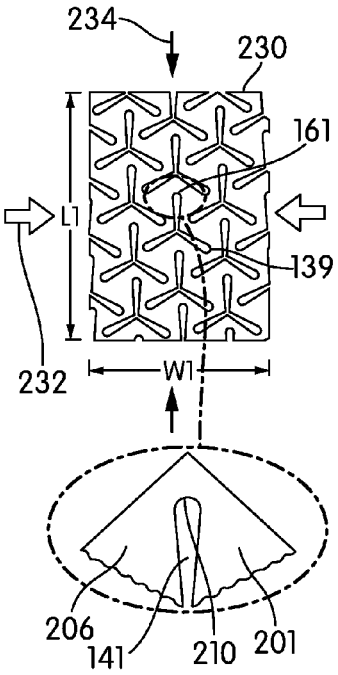
FIG. 4 shows a schematic diagram of a bottom view of the portion of the outsole of FIG. 3 in a compression configuration, in accordance with exemplary embodiments.
Figure 5:
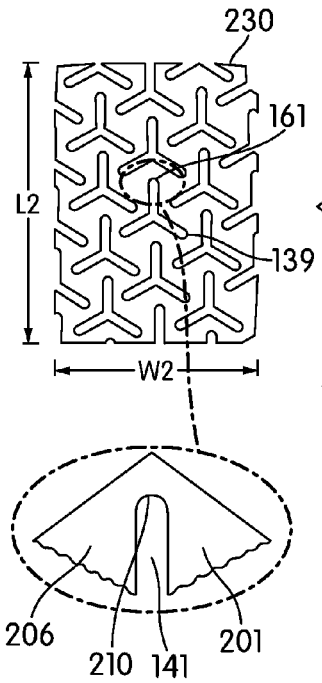
FIG. 5 shows a schematic diagram of a bottom view of the portion of the outsole of FIG. 3 in a relaxed configuration, in accordance with exemplary embodiments.
Figure 6:
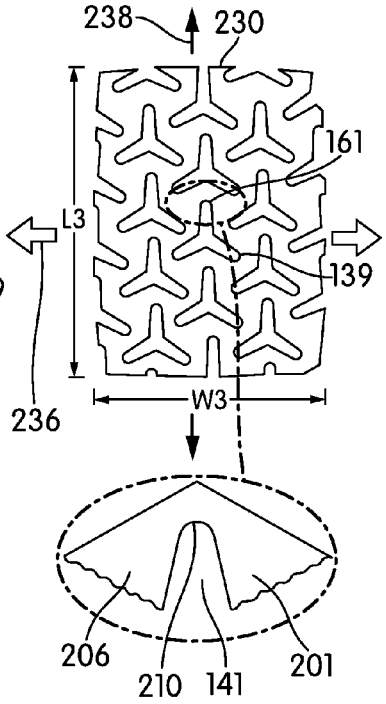
FIG. 6 shows a schematic diagram of a bottom view of the portion of the outsole of FIG. 3 in an expansion configuration, in accordance with exemplary embodiments.

FIGS. 4-6 illustrate a schematic sequence of configurations for a portion of auxetic structure 140 under various forces applied along a single axis or direction. Specifically, FIGS. 4-6 are intended to illustrate how the geometric arrangements of voids 131 and sole portions 200 provide auxetic properties to auxetic structure 140, thereby allowing portions of auxetic structure 140 to expand in both the direction of applied tension and a direction perpendicular to the direction of applied tension.

As shown in FIGS. 4-6, an exposed surface 230 of auxetic structure 140 proceeds through various configurations as a result of an applied tension in a linear direction (for example, the longitudinal direction). In particular, the configuration of FIG. 4 may be associated with a compression force 232 applied along a first direction and associated with a compression 234 along a second direction that is orthogonal to the first direction of compression force 232. Additionally, the configurations of FIG. 5 may be associated with a relaxed state. Finally, the configuration of FIG. 6 may be associated with a tensioning force 236 applied along a first direction and associated with an expansion 238 along a second direction that is orthogonal to the first direction of tensioning force 236. It should be understood that the configurations are of an outer surface of an auxetic structure and the configurations of the inner surface may remain constant. For example, as shown in FIG. 2, the inner surface may be attached to the lower surface. In another example, the inner surface may be constrained by the lower surface.

Due to the specific geometric configuration for sole portions 200 and their attachment via hinge portions, the compression and expansion is transformed into rotation of adjacent sole portions 200. For example, first polygonal portion 201 and sixth polygonal portion 206 are rotated at hinge portion 210. All of the remaining sole portions 200 are likewise rotated as voids 131 compress or expand. Thus, the relative spacing between adjacent sole portions 200 changes according to the compression or expansion. For example, as seen clearly in FIG. 4, the relative spacing between first polygonal portion 201 and sixth polygonal portion 206 (and thus the size of first radial segment 141 of void 139) decreases with increased compression. In another example, as seen clearly in FIG. 6, the relative spacing between first polygonal portion 201 and sixth polygonal portion 206 (and thus the size of first radial segment 141 of void 139) increases with increased expansion.

As the increase in relative spacing occurs in all directions (due to the symmetry of the original geometric pattern of voids), this results the expansion of exposed surface 230 along a first direction as well as along a second direction orthogonal to the first direction. For example, in the exemplary embodiment of FIG. 4, in the compression configuration, exposed surface 230 initially has an initial size W1 along a first linear direction (e.g., the longitudinal direction) and an initial size L1 along a second linear direction that is orthogonal to the first direction (e.g., the lateral direction). In another example, in the exemplary embodiment of FIG. 5, in the relaxed configuration, exposed surface 230 has a size W2 along a first linear direction (e.g., the longitudinal direction) and a size L2 along a second linear direction that is orthogonal to the first direction (e.g., the lateral direction). In the expansion configuration of FIG. 6, exposed surface 230 has an increased size W3 in the first direction and an increased size L3 in the second direction. Thus, it is clear that the expansion of exposed surface 230 is not limited to expansion in the tensioning direction.

In some embodiments, the amount of compression and/or expansion (e.g., the ratio of the final size to the initial size) may be approximately similar between the first direction and the second direction. In other words, in some cases, exposed surface 230 may expand or contract by the same relative amount in, for example, both the longitudinal direction and the lateral direction. In contrast, some other kinds of structures and/or materials may contract in directions orthogonal to the direction of applied expansion. It should be understood that an inner surface of the auxetic structure position on the opposite side from the exposed surface 230 may be constrained due to, for example, an attachment to a plate. For example, the inner surface 211 may be constrained due to an attachment of the auxetic structure 140 to plate 220 that bonds a substantial portion of the inner surface 211 to lower surface 208 (see FIG. 2).

In the exemplary embodiments shown in the figures, an auxetic structure may be tensioned in the longitudinal direction or the lateral direction. However, the arrangement discussed here for auxetic structures comprised of voids surrounded by geometric portions provides a structure that can expand or contract along any first direction along which tension is applied, as well as along a second direction that is orthogonal to the first direction. Moreover, it should be understood that the directions of expansion, namely the first direction and the second direction, may generally be tangential to a surface of the auxetic structure. In particular, the auxetic structures discussed here may generally not expand in a vertical direction that is associated with a thickness of the auxetic structure.

Figure 7:
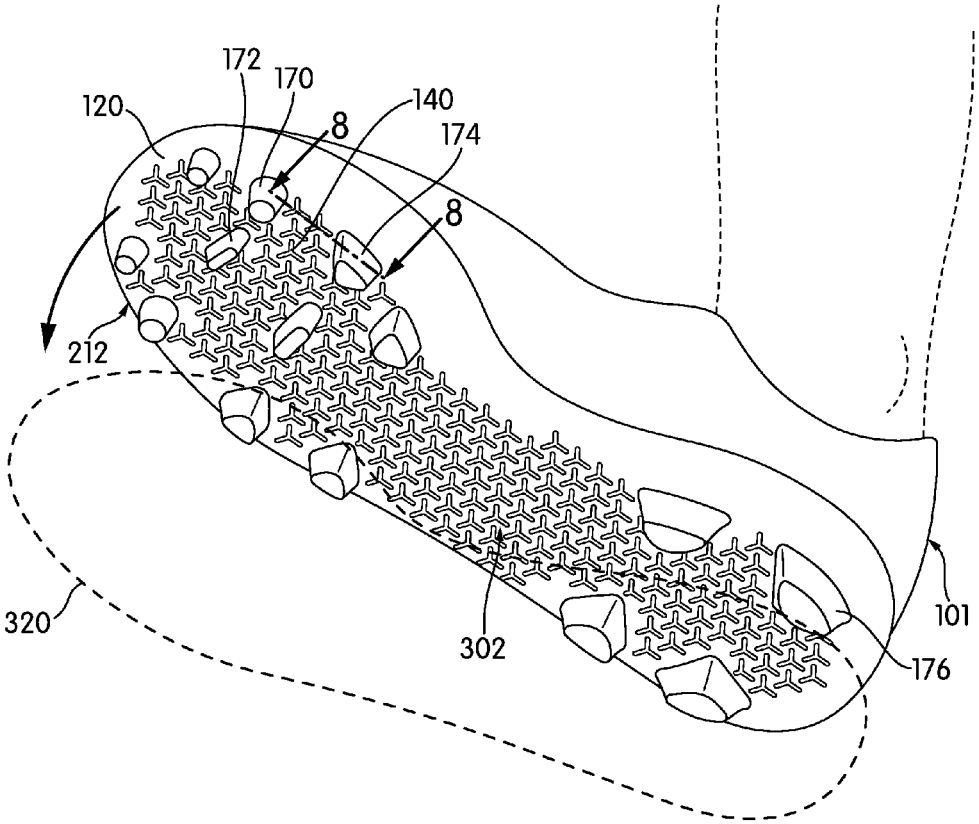
FIG. 7 is a schematic diagram of a sole structure prior to impact with a playing surface, in accordance with exemplary embodiments.
Figure 8:
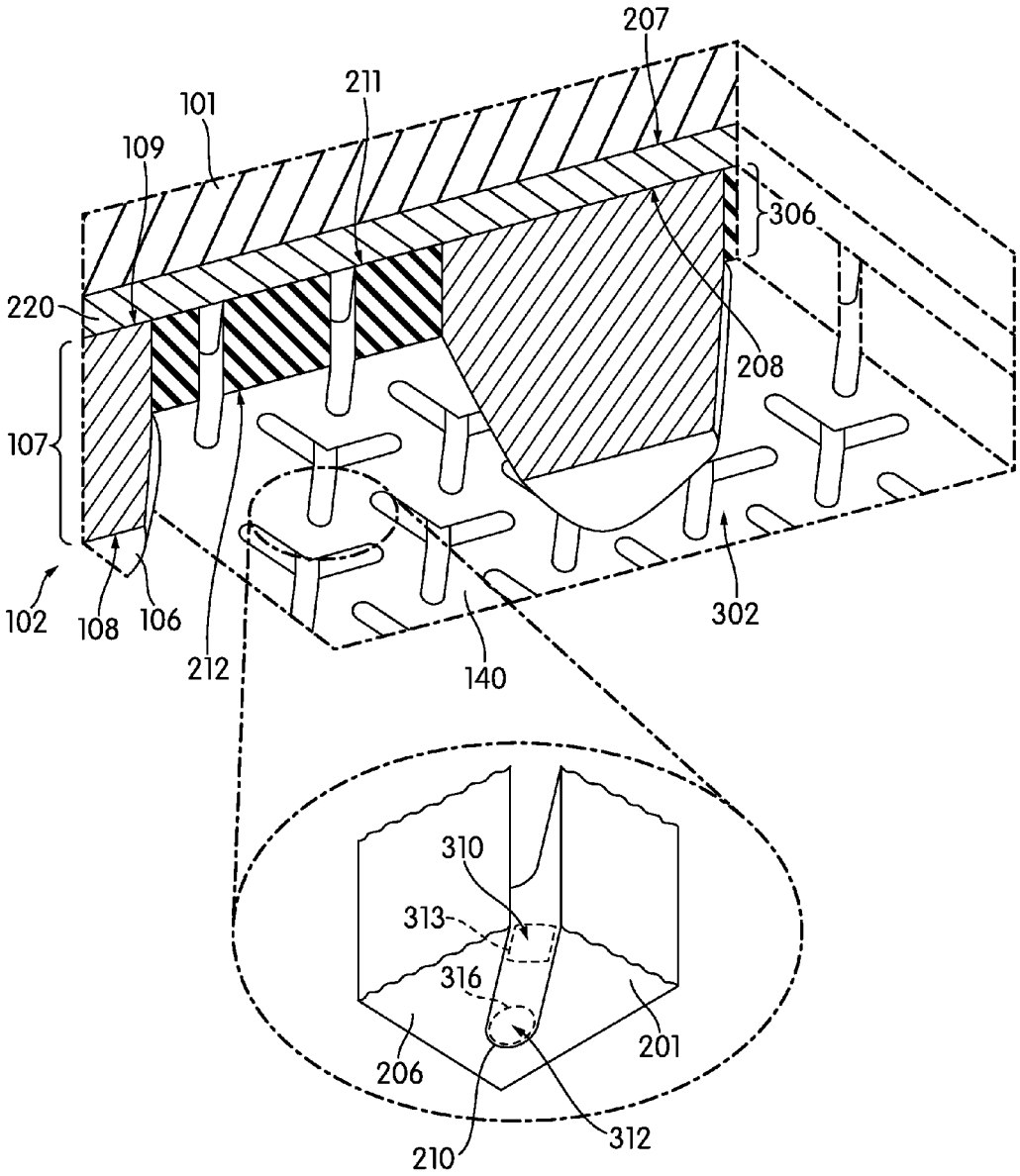
FIG. 8 is a cut away view of the sole structure of FIG. 7, in accordance with exemplary embodiments.
Figure 9:
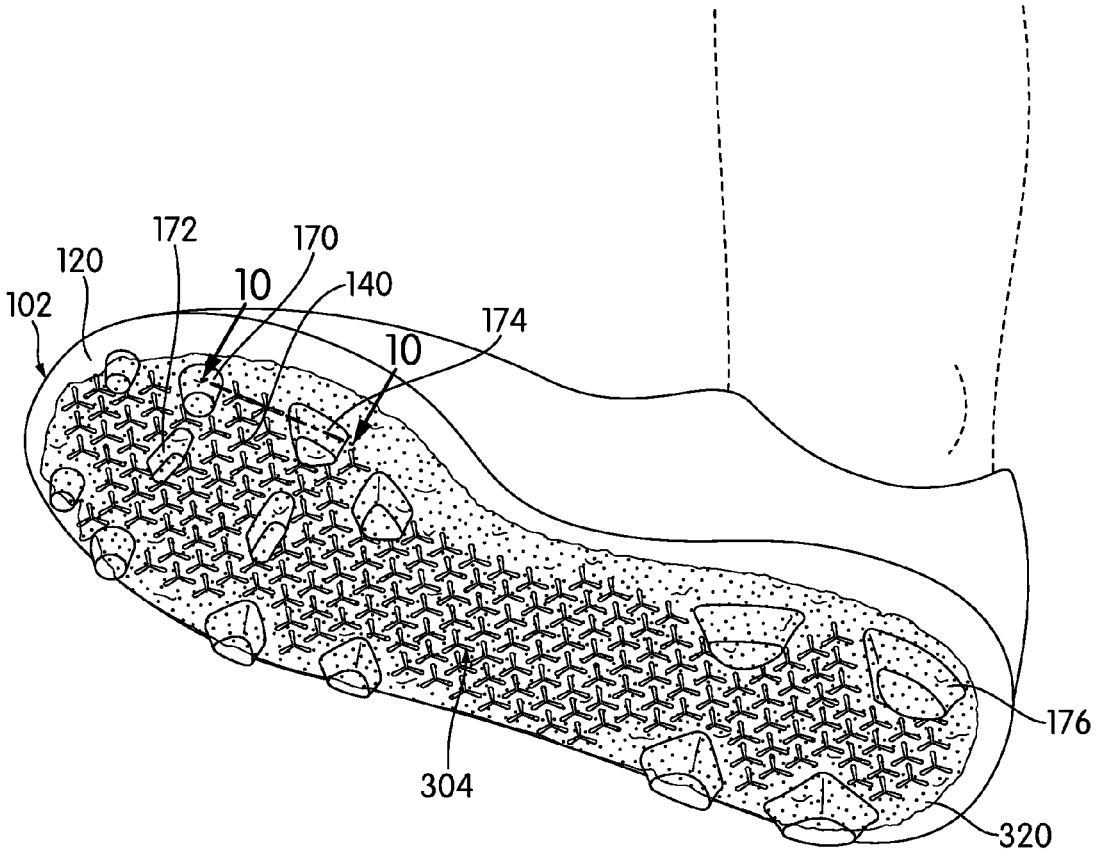
FIG. 9 is a schematic diagram of a sole structure during an impact with a playing surface, in accordance with exemplary embodiments.
Figure 10:
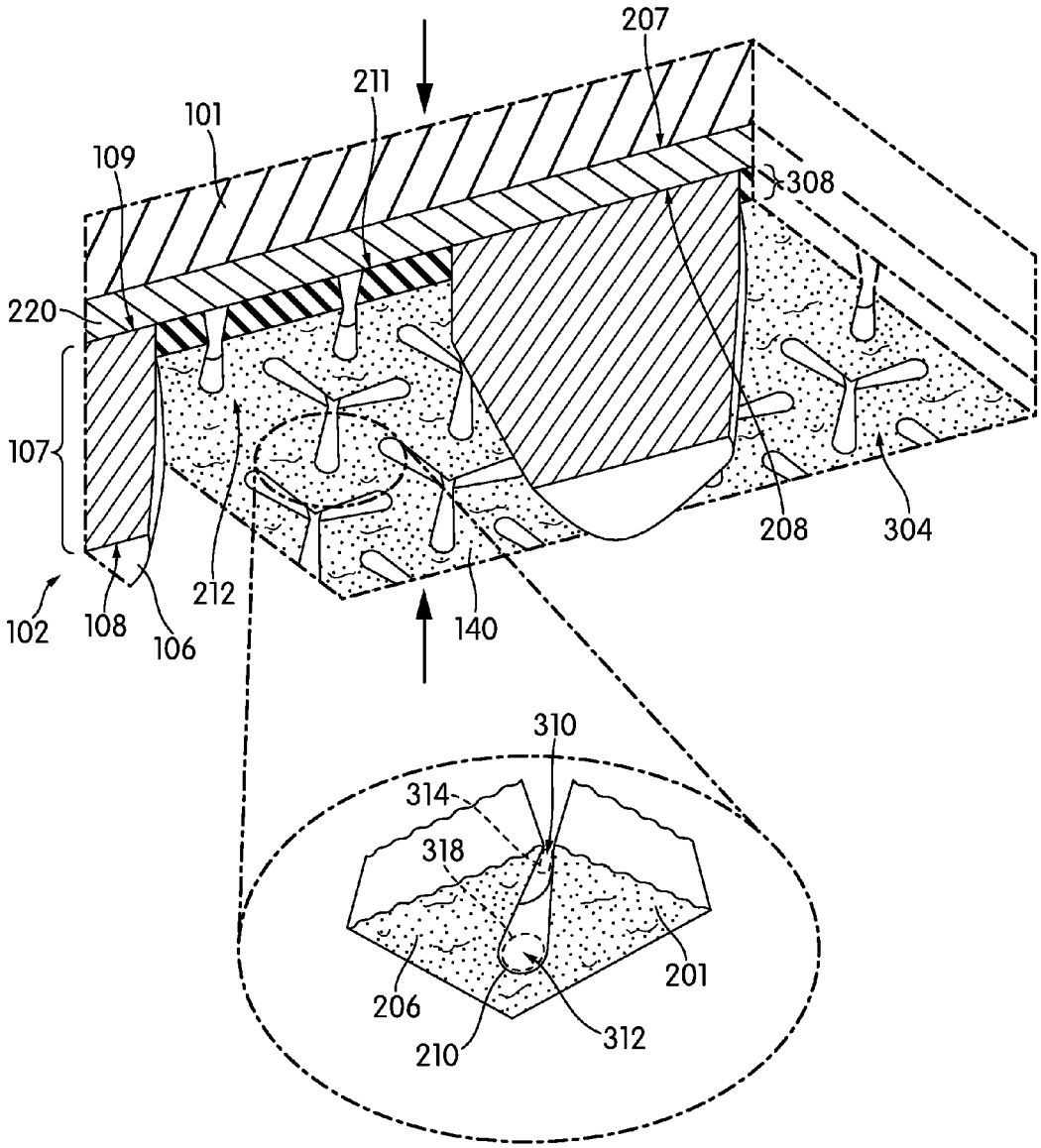
FIG. 10 is a cut away view of the sole structure of FIG. 9, in accordance with exemplary embodiments.

In certain embodiments, the outer surface of the auxetic structure changes a surface area in response to a compressive force. For example, as shown in FIGS. 7 and 8, the outer surface 212 has a first surface area 302 when not exposed to a compressive force. In the example, as shown in FIGS. 9 and 10, the outer surface 212 has a second surface area 304 when exposed to the compressive force. In an exemplary embodiment, the second surface area 304 may be greater than the first surface area 302. In other words, the surface area of outer surface 212 may expand under compression. In some embodiments, the second surface area is at least five percent more than the first surface area. For example, as shown, the second surface area 304 is at least five percent more than the first surface area 302. In other examples, the second surface area is more than the first surface area by at least ten percent, at least fifteen percent, at least twenty percent, etc. In some embodiments, the compressive force is associated with an impact of an article on a playing surface. For example, the compressive force may be more than 1,000 Newtons.

In some embodiments, a compressive force modifies a separation distance between the inner surface and the outer surface. For example, as shown in FIGS. 8 and 10, a compressive force with a playing surface 320 modifies a separation distance between the inner surface 211 and the outer surface 212 from non-compressed separation distance 306 to compressed separation distance 308. In certain embodiments, the compressive force reduces the separation distance such that the compressed separation distance 308 is less than non-compressed separation distance 306 by at least ten percent. Alternatively, the compressive force could reduce the separation distance by as much as fifty percent or even more than fifty percent. In various embodiments, the compressive force is in a direction associated with a thickness of the auxetic structure.

The separation distance between the inner surface and the outer surface may be less than the height of the cleat. In some embodiments, the non-compressed separation distance is less than the height of the cleat. For example, as shown in FIG. 8, non-compressed separation distance 306 is less than the height 107 of the cleat 106. In certain embodiments, the non-compressed separation distance is less than half the height, less than ¾ the height, etc. For example, the non-compressed separation distance 306 is less than half the height 107 and less than ¾ the height 107. Similarly, in various embodiments, the compressed separation distance is less than the height of the cleat. For example, as shown in FIG. 10, compressed separation distance 308 is less than the height 107 of the cleat 106. In certain embodiments, the compressed separation distance is less than half the height, less than ¾ the height, etc. For example, the compressed separation distance 308 is less than half the height 107 and less than ¾ the height 107.

In certain embodiments, surface areas of portions of voids change differently in response to the compressive force. For example, as discussed with respect to FIGS. 4-6, first polygonal portion 201 and sixth polygonal portion 206 are rotated at hinge portion 210. In FIGS. 8 and 10, reference is made to a first void portion 310 and a second void portion 312 of radial segment 141 of void 139. As seen in FIG. 8, first void portion 310 may be disposed closer to a center of void 139, while second void portion 312 may be disposed proximate to hinge portion 210. Moreover, first void portion 310 may be associated with a non-compressed area 313, which may generally have a polygonal shape. Also, second void portion 312 may be associated with a non-compressed area 316, which may generally have a rounded shape.

Accordingly, in various embodiments, a compressive force may decrease a surface area of a first void portion 310 more than a second void portion 312. For example, as shown in FIGS. 8 and 10, a compressive force may decrease the first void portion 310 from a non-compressed area 313 to a compressed area 314. In another example, as shown in FIGS. 8 and 10, a compressive force may decrease the second void portion 312 from a non-compressed area 316 to a compressed area 318. As clearly shown, the area of first void portion 310 is decreased much more than the area of second void portion 312. In some cases, for example, the associated decrease in the area of first void portion 310 could be ten percent greater than the associated decrease in the area of second void portion 312.

Figure 11:
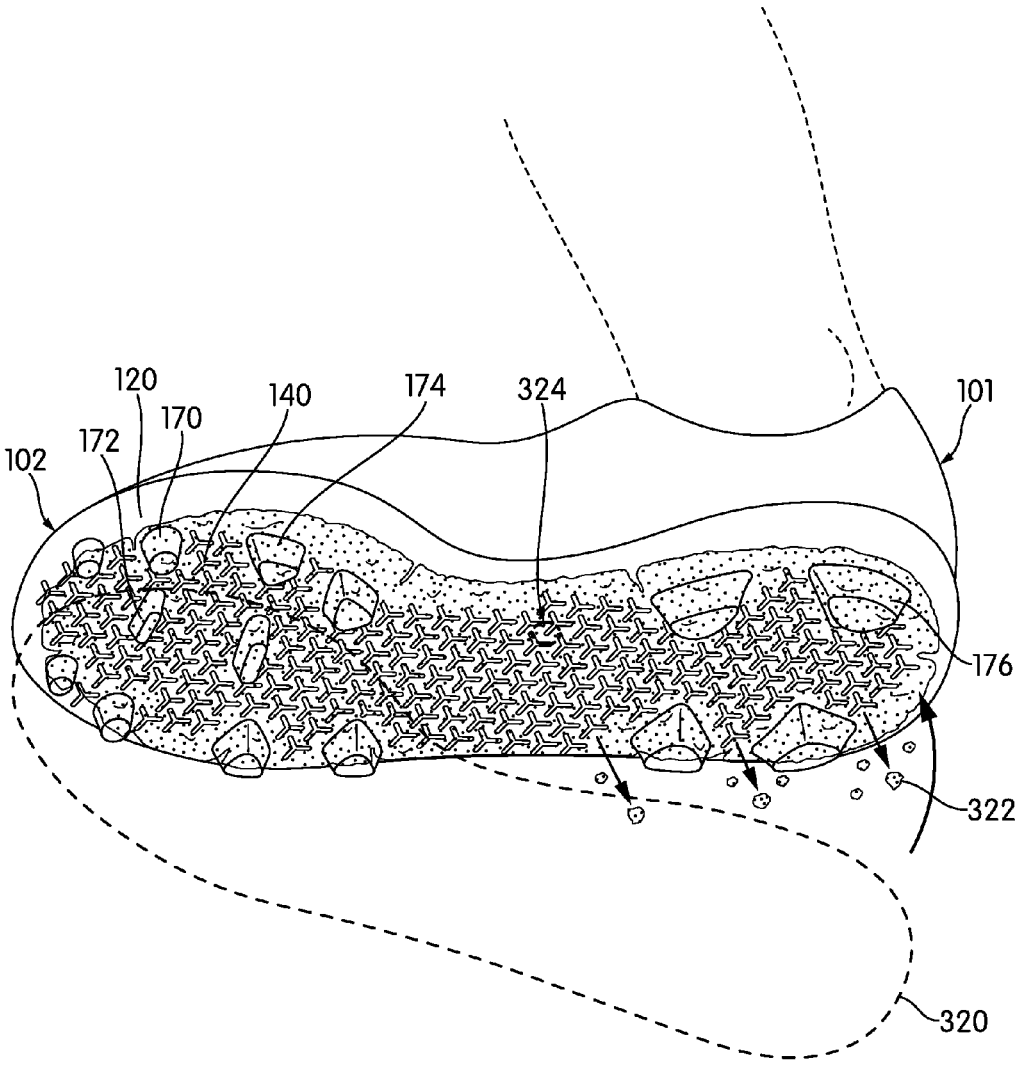
FIG. 11 is a schematic diagram of a sole structure after impact with a playing surface, in accordance with exemplary embodiments.

In some embodiments, the difference in changes to portions of the voids facilitates a declogging function of the sole. For example, as illustrated in FIG. 11, the auxetic structure 140 may help to remove debris 322 from the sole 102.

Accordingly, in some embodiments, the addition of the auxetic structure, as described in the various embodiments, may improve a non-clogging property of a resulting article. In some embodiments, an adherence of debris onto the outer surface may be at least fifteen percent less than an adherence of debris onto a control outsole. For example, an adherence of debris 322 onto the outer surface 212 may be at least fifteen percent less than an adherence of debris onto a control outsole. In some embodiments, the control outsole may be identical to the sole structure except that the control outsole does not include the auxetic structure. For example, the control outsole may be identical to the sole 102 except that the control outsole does not include the auxetic structure 140. In various embodiments, the control outsole may include a control plate having an exposed control surface. For example, the control outsole may include a control plate similar to the plate 220 having an exposed control surface (not shown).

Moreover, in various embodiments, the addition of the auxetic structure, as described in the various embodiments, may improve a non-clogging performance of a resulting article. In some embodiments, following a 30 minute wear test on a wet grass field, a weight of debris adsorbed to the outer surface may be at least fifteen percent less than a weight of debris adsorbed to a control outsole. For example, following a 30 minute wear test on a wet grass field, a weight of debris adsorbed to the outer surface 212 may be at least fifteen percent less than a weight of debris adsorbed to a control outsole. In various embodiments, the control outsole may be identical to the sole structure except that the control outsole does not include the auxetic structure (not shown). In certain embodiments, the control outsole may include a control plate having an exposed control surface. For example, the control outsole may include a control plate similar to the plate 220 having an exposed control surface (not shown).

Figure 12:
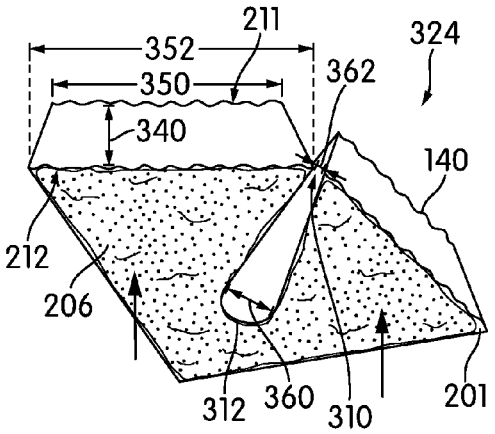
FIG. 12 is an enlarged view of the sole structure of FIG. 11 while in a compressed state, in accordance with exemplary embodiments.
Figure 13:
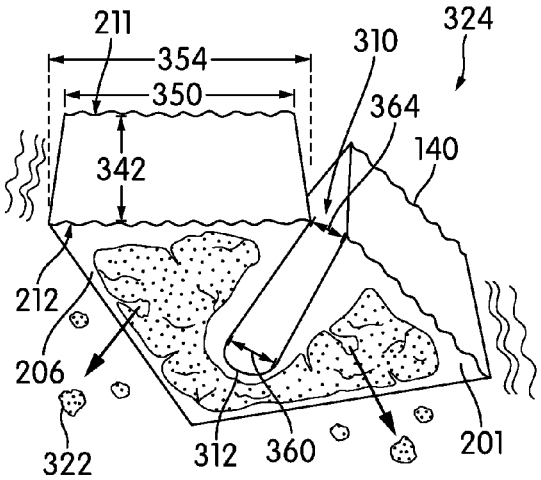
FIG. 13 is an enlarged view of the sole structure of FIG. 11 during a first stage of uncompressing, in accordance with exemplary embodiments.
Figure 14:
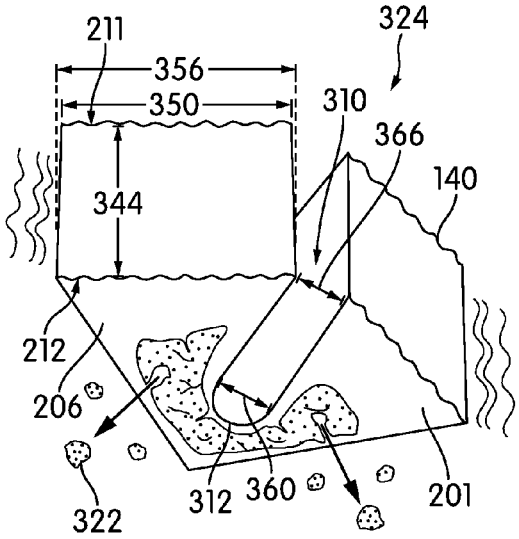
FIG. 14 is an enlarged view of the sole structure of FIG. 11 during a second stage of uncompressing, in accordance with exemplary embodiments.
Figure 15:
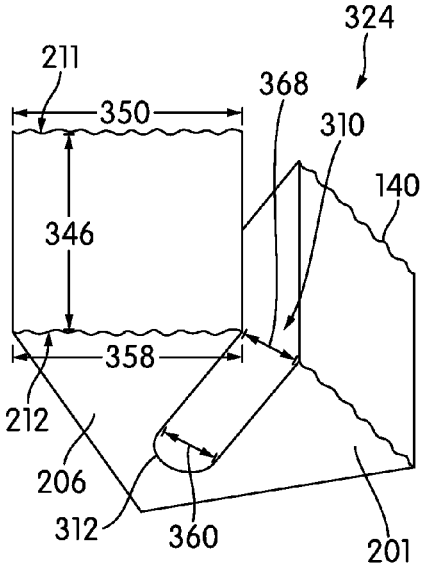
FIG. 15 is an enlarged view of the sole structure of FIG. 11 while in an uncompressed state, in accordance with exemplary embodiments.

In various embodiments, such a removal of debris is a result of sheer force on the outer surface when exposed to a compressive force. For example, as shown in FIGS. 12-15, decompression of the auxetic structure 140 may cause a sheer force that helps to remove debris from the article 100. As shown in FIG. 12, a compressive force may result in the auxetic structure 140 having a height 340. As shown in FIG. 13, the auxetic structure 140 expands outward as it decompresses resulting in height 342. Next, as shown in FIG. 14, the auxetic structure 140 expands outward as it decompresses resulting in height 344. Finally, as shown in FIG. 15, the auxetic structure 140 has a height 346 when in an uncompressed state that is greater than the height 344. As discussed further, the auxetic structure 140 changing from height 340 to height 346 may result in sheer forces on the outer surface 212 that help to remove debris 322.

The sheer force may result from changing surface areas of the auxetic structure during a decompression of the auxetic structure. In some embodiments, such a change in surface area may be due to a change in relative lengths between the inner surface of the auxetic structure and the outer surface of the auxetic structure. For example, as shown in FIG. 12, the inner surface 211 of the portion 324 has a length 350 that is smaller than the length 352 of the outer surface 212. As shown in FIG. 13, the outer surface 212 of the portion 324 reduces from length 352 to length 354 during a first stage of uncompressing. Next, as shown in FIG. 14, the outer surface 212 of the portion 324 reduces from length 354 to length 356 during a second stage of uncompressing. Finally, as shown in FIG. 15, the outer surface 212 of the portion 324 has a length 358 that is less than length 356 while in an uncompressed state. In some embodiments, such a reduction in length in the outer surface may result in sheer forces that help to remove debris from the outer surface. For example, such a relative reduction in length in the outer surface 212 from length 352 to length 358 may result in sheer forces on the outer surface 212 that help to remove debris 322 from the outer surface 212.

In some embodiments, the length of the inner surface may remain constant during a decompression of the auxetic structure. For example, as shown in FIGS. 12-15, the inner surface 211 may remain within ten percent of the length 350 during a decompression of the auxetic structure 140. Additionally, the length of the inner surface may remain constant while a length of the outer surface may change. For example, as shown in FIGS. 12-15, the inner surface 211 may remain within ten percent of the length 350 while the outer surface 212 changes from length 352 to length 358.

The relative lengths between the inner surface of the auxetic structure and the outer surface of the auxetic structure may vary. In some embodiments, the length of the inner surface is equal to the length of the outer surface while in an uncompressed state. For example, as shown in FIG. 15, the length 350 of the inner surface 211 is equal to the length 358 of the outer surface 212 while in an uncompressed state. In other embodiments, the relative lengths are different during an uncompressed state (not shown).

In some instances, the sheer force may result from changes in a relative spacing between adjacent polygonal portions. For example, as shown in FIG. 12, the first polygonal portion 201 is spaced from the sixth polygonal portion 206 at the second void portion 312 by a length 360. In the example, the first polygonal portion 201 is spaced from the sixth polygonal portion 206 at the first void portion 310 by a length 362 that is smaller than length 360. Next, as shown in FIG. 13, during a first stage of uncompressing, the spacing between the first polygonal portion 201 and the sixth polygonal portion 206 expands from length 362 to length 364 at the first void portion 310. Further, as shown in FIG. 14, during a second stage of uncompressing, the spacing between the first polygonal portion 201 and the sixth polygonal portion 206 expands from length 364 to length 366 at the first void portion 310. Finally, as shown in FIG. 15, while in an uncompressed state, the spacing between the first polygonal portion 201 and the sixth polygonal portion 206 has a length 368 that is less than length 366. In certain embodiments, such an increase in relative spacing between adjacent polygonal portions may result in sheer forces that help to remove debris from the outer surface. For example, such an increase in the first void portion 310 from the length 362 to the length 368 may result in sheer forces that help to remove debris 322 from the outer surface 212.

In some embodiments, the length at the polygonal void portion may be equal to the length at the hinge void portion while in the uncompressed state. For example, as shown in FIGS. 12-15, the length 368 at the first void portion 310 may be equal to the length 360 at the second void portion 312 while in the uncompressed state. Additionally, the length at the hinge void portion may remain constant while the length at the polygonal void portion changes. For example, as shown in FIGS. 12-15, the length 360 at the second void portion 312 may remain constant while the first void portion 310 changes from length 362 to length 368.

The relative spacing between adjacent polygonal portions at the polygonal void portion and at the hinge void portion may vary. In some embodiments, the spacing between adjacent polygonal portions at the polygonal void portion and at the hinge void portion may be equal while in an uncompressed state. For example, as shown in FIG. 15, the length 360 at the second void portion 312 is equal to the length 368 at the first void portion 310 while in an uncompressed state. In other embodiments, the relative lengths are different during an uncompressed state (not shown).

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

an upper;

a plate having an upper surface attached to the upper and having a lower surface;

a plurality of cleats extending from the lower surface;

an auxetic structure having an inner surface affixed to the lower surface and having an outer surface;

wherein the inner surface is constrained by the lower surface; and wherein the outer surface is spaced closer to the lower surface than to a first tip surface of a first cleat of the plurality of cleats.

2. The article of footwear according to claim 1, wherein the auxetic structure has a tristar-shaped pattern.

3. The article of footwear according to claim 2, wherein the tristar-shaped pattern comprises a plurality of tristar-shaped voids, each tristar-shaped void comprising a center and three radial segments extending from the center.

4. The article of footwear according to claim 3, wherein each of the three radial segments of a tristar-shaped void of the plurality of tristar-shaped voids extends a distance identical to the other segments of the tristar-shaped void.

5. The article of footwear according to claim 4, wherein the distance is 1/50 to 1/2 a height of the first cleat.

6. The article of footwear according to claim 4, wherein a first radial segment of the three radial segments of the tristar-shaped void of the plurality of tristar-shaped voids has a central angle with a second radial segment of the three radial segments identical to a central angle with a third radial segment of the three radial segments.

7. The article of footwear according to claim 4, wherein each of the three radial segments of the tristar-shaped void is substantially aligned with a radial segment of another one of the plurality of tristar-shaped voids.

8. The article of footwear according to claim 1, wherein the auxetic structure is formed of a compliant foam, a solid rubber, or thermoplastic polyurethane.

9. A sole for an article of footwear, the sole comprising:

a plate having a lower surface;

a plurality of cleats extending from the lower surface, each of the plurality of cleats being attached to the lower surface;

an auxetic structure having an inner surface attached to the lower surface and having an outer surface, the outer surface including a plurality of voids;

wherein the inner surface is constrained by the lower surface;

wherein the auxetic structure reduces a surface area of the plurality of voids in response to a compression of the auxetic structure; and wherein the outer surface is spaced closer to the lower surface than to a first tip surface of a first cleat of the plurality of cleats.

10. The sole for the article of footwear according to claim 9, wherein the compression of the auxetic structure modifies a separation distance between the inner surface and the outer surface.

11. The sole for the article of footwear according to claim 9, wherein the compression of the auxetic structure results in a first decrease in a first portion of a void of the plurality of voids and wherein the compression of the auxetic structure results in a second decrease in a second portion of the void; and wherein the first decrease is greater than the second decrease.

12. The sole for the article of footwear according to claim 9, wherein the auxetic structure has a negative Poisson's ratio.

13. The sole for the article of footwear according to claim 9, wherein the auxetic structure has a thickness of 1/100 to 1/3 a height of the first cleat.

14. The sole for the article of footwear according to claim 9, wherein a substantial portion of the inner surface is bonded to the lower surface.

15. A sole for an article of footwear, the sole comprising:

a plate having a lower surface;

a first cleat extending from the lower surface, the first cleat being attached to the lower surface;

an auxetic structure having an inner surface attached to the lower surface and having an outer surface, the outer surface including a plurality of voids;

wherein the inner surface is constrained by the lower surface; and wherein the inner surface and the outer surface are spaced by a first separation distance of less than 1/2 of a height of the first cleat.

16. The sole for the article of footwear according to claim 15, wherein the first cleat has a first tip surface; and wherein the outer surface is spaced closer to the lower surface than to the first tip surface.

17. The sole for the article of footwear according to claim 15, wherein the outer surface includes a recessed surface; and wherein the recessed surface is spaced closer to the lower surface than to the tip surface.

18. The sole for the article of footwear according to claim 15, wherein the inner surface and the recessed surface are spaced by a second separation distance; and wherein the second separation distance is more than 1/2 of the first separation distance.

19. The sole for the article of footwear according to claim 15, wherein the first tip surface is a ground engaging surface of the article of footwear.

20. The sole for the article of footwear according to claim 15, wherein a substantial portion of the inner surface is bonded to the lower surface.

21. A sole structure for an article of footwear, the sole structure comprising:

a plate having an upper surface and a lower surface;

a first cleat attached to the lower surface, the first cleat having a first height and having a first tip surface;

an auxetic structure having an inner surface affixed to the lower surface and having an outer surface, wherein the outer surface includes a plurality of voids;

wherein the inner surface is constrained by the lower surface; and wherein the outer surface is spaced closer to the lower surface than to the first tip surface;

wherein the outer surface has a first surface area when not exposed to a compressive force and wherein the outer surface has a second surface area when exposed to the compressive force;

wherein the second surface area is at least five percent more than the first surface area; and wherein the outer surface is spaced closer to the lower surface than to the first tip surface.

22. The sole structure according to claim 21, wherein the compressive force modifies a separation distance between the inner surface and the outer surface.

23. The sole structure according to claim 21, wherein a first void of the plurality of voids includes a first portion and a second portion;

wherein the compressive force results in a first decrease in a surface area of the first portion;

wherein the compressive force results in a second decrease of a surface area of the second portion; and wherein the first decrease is at least five percent greater than the second decrease.

24. The sole structure according to claim 21, wherein the upper surface is attached to an upper of an article of footwear.

25. The sole structure according to claim 21, wherein an adherence of debris onto the outer surface is at least 15% less than an adherence of debris onto a control outsole;

wherein the control outsole is identical to the sole structure except that the control outsole does not include the auxetic structure; and wherein the control outsole includes a control plate having an exposed control surface.

26. The sole structure according to claim 21, wherein, following a 30 minute wear test on a wet grass field, a weight of debris adsorbed to the outer surface is at least 15% less than a weight of debris adsorbed to a control outsole;

wherein the control outsole is identical to the sole structure except that the control outsole does not include the auxetic structure; and wherein the control outsole includes a control plate having an exposed control surface.

27. A method of manufacturing a sole structure comprising:

providing a plate having an upper surface and a lower surface, the plate being configured to receive a first cleat having a first height;

providing an auxetic structure having an inner surface and an outer surface;

wherein a separation distance between the inner surface and the outer surface is less than half of the first height;

bonding the inner surface to the lower surface; and wherein the inner surface is constrained by the lower surface following the bonding.

28. The method according to claim 27, wherein the auxetic structure includes a tristar-shaped pattern.

29. The method according to claim 27, wherein the bonding bonds a substantial portion of the inner surface to the lower surface.

30. The method according to claim 27, further comprising the step of forming the auxetic structure of one or more of ethylene vinyl acetate (EVA), polyisoprene, polybutadiene, polyisobutylene, and polyurethanes.

31. The method according to claim 27, further comprising the step of forming the auxetic structure of one or more of acrylic, nylon, polybenzimidazole, polyethylene, polypropylene, polystyrene, polyvinyl chloride (PVC), and polytetrafluoroethylene (PTFE).

32. The method according to claim 27, further comprising:

providing an upper of an article of footwear; and attaching the upper to the upper surface.

* * * * *